US011471906B2

(12) United States Patent
Lee

(10) Patent No.: US 11,471,906 B2
(45) Date of Patent: Oct. 18, 2022

(54) COSMETIC CONTAINER

(71) Applicant: SAMHWA CO., LTD, Uiwang-si (KR)

(72) Inventor: Kyungchang Lee, Uiwang-si (KR)

(73) Assignee: SAMHWA, CO., LTD, Uiwang-si (KR)

( * ) Notice: Subject to any disclaimer, the term of this patent is extended or adjusted under 35 U.S.C. 154(b) by 0 days.

(21) Appl. No.: 17/369,901

(22) Filed: Jul. 7, 2021

(65) Prior Publication Data

US 2022/0055055 A1 Feb. 24, 2022

(30) Foreign Application Priority Data

Aug. 24, 2020 (KR) ..... 10-2020-0106163

(51) Int. Cl.
*B05B 11/00* (2006.01)
*A45D 34/04* (2006.01)

(52) U.S. Cl.
CPC ..... *B05B 11/3083* (2013.01); *A45D 34/04* (2013.01); *B05B 11/3005* (2013.01); *B05B 11/3084* (2013.01); *A45D 2200/05* (2013.01)

(58) Field of Classification Search
CPC ..... B05B 11/3083; B05B 11/3005; B05B 11/3084; A45D 34/04
USPC ..... 222/145.5
See application file for complete search history.

(56) References Cited

U.S. PATENT DOCUMENTS

2001/0027983 A1* 10/2001 Stadelhofer ..... B05B 11/3007 222/434
2010/0044394 A1* 2/2010 Milian ..... B65D 83/384 222/137
2014/0054317 A1* 2/2014 Brugger ..... B65D 83/525 222/144.5
2020/0171523 A1* 6/2020 Langlois ..... B05B 11/3084
2021/0031217 A1* 2/2021 Chen ..... B05B 11/3083

FOREIGN PATENT DOCUMENTS

KR 10-1951627 B1 2/2019
KR 10-2019-0034076 A 4/2019
WO 2009/134129 A1 11/2009
WO 2014/034995 A1 3/2014
WO WO-2014034995 A1 * 3/2014 ..... B05B 11/3008
WO 2021/133736 A1 7/2021

* cited by examiner

*Primary Examiner* — Jeremy Carroll
(74) *Attorney, Agent, or Firm* — Park, Kim & Suh, LLC

(57) ABSTRACT

A cosmetic container is disclosed with which the dispensing amount of the content can be varied. A cosmetic container according to one aspect of the invention can include: a storage part that stores a content; a pump that is coupled to the storage part to dispense the content and includes a valve configured to move downward when pressed; a handle that is rotatably coupled to an upper portion of the storage part; a transfer member that is interlocked with the handle and configured to transfer the rotation of the handle to a valve guide; and the valve guide configured to move upward or downward along an exterior of the valve when rotated by the transfer member, where rotating the handle can adjust the relative position of the valve guide with respect to the valve to allow a varying of the dispensing amount of the content.

14 Claims, 13 Drawing Sheets

COSMETIC CONTAINER

CROSS-REFERENCE TO RELATED APPLICATIONS

This application claims the benefit of Korean Patent Application No. 10-2020-0106163, filed with the Korean Intellectual Property Office on Aug. 24, 2020, the disclosure of which is incorporated herein by reference in its entirety.

BACKGROUND

1. Technical Field

The present invention relates to a cosmetic container with which the dispensing amount of the content can be varied.

2. Description of the Related Art

A container holding a liquid or gel type content (such as a cosmetic, shampoo, cleaning agent, etc.) may have a pump coupled to an upper portion of the container as a device for discharging the content. When a user presses down on the top of the pump, the pressure within the pump may be changed and the valve may be opened, forcing the content to be dispensed through the pump to the outside. Such a pump can prevent the content from being exposed to the outside, thereby preventing the content from spoiling and hence providing an advantage in terms of good hygiene.

A problem found in the conventional pump is that the amount of content dispensed may not be constant, depending on the extent to which the pump is pressed down. That is, if the pump is pressed down with a large force such that the valve, etc., within is moved by a large distance, the dispensed amount may be large, whereas if the pump is pressed with a small force such that the valve, etc., is moved by a small distance, the dispensed amount may be small. Thus, with the conventional pump, the dispensing amount cannot be adjusted precisely.

One form of container currently used involves holding two different types of contents separately and allowing the contents to be mixed at the time of use. This form of mixing container is mainly used in cases where a mixture of the two different types of contents provides a synergetic effect but where a premature mixing of the two different contents before the time of use causes the contents to spoil or exhibit a lowered performance after a prolonged period of distribution.

In such a mixing container also, the effect of the mixing can be maximized by supplying the two different types of contents in a constant mixture ratio.

PRIOR ART

Patent Document (Patent Document 1) Korean Patent Publication No. 2019-0034076

SUMMARY OF THE INVENTION

The present invention has been conceived to address the problems above, and one aspect of the present invention is to provide a cosmetic container that can variably adjust the dispensing amount of the content.

Another aspect of the present invention is to provide a cosmetic container that can adjust the dispensing amounts for two types of contents independently.

Other objectives of the invention will be more clearly understood from the embodiments described below.

A cosmetic container according to one aspect of the invention can include: a storage part that stores a content; a pump that is coupled to the storage part to dispense the content and includes a valve configured to move downward when pressed; a handle that is rotatably coupled to an upper portion of the storage part; a transfer member that is interlocked with the handle and configured to transfer the rotation of the handle to a valve guide; and the valve guide configured to move upward or downward along an exterior of the valve when rotated by the transfer member, where rotating the handle can adjust the relative position of the valve guide with respect to the valve to allow a varying of the dispensing amount of the content.

A cosmetic container according to an embodiment of the invention can include one or more of the following features. For example, the transfer member can be provided at the inner side of the handle.

A handle gear can be formed on the inner perimeter of the handle, the transfer member can include a spur gear that is interlocked with the handle gear and a spring washer that is configured to rotate together with the spur gear as an integrated body at the inner side of the spur gear, and the spring washer can guide the upward and downward movement of the valve guide while rotating together with the valve guide as an integrated body.

A guide protrusion shaped as a thread can be formed on the outer perimeter of the valve, and a guide thread can be formed in the inner perimeter of the valve guide, where the guide protrusion can be rotatably inserted in the guide thread.

The pump can include a piston guide, which may be coupled to the valve and which may include an inlet hole, and a piston, which may be coupled to an exterior of the piston guide and may be capable of closing the inlet hole, where the one-time dispensing amount of the pump can be adjusted in proportion to the distance between the valve guide and the piston.

The cosmetic container can include two storage parts and two pumps, the handle can include an upper handle and a lower handle having different heights, and the transfer member can include an upper transfer member interlocked with the upper handle and a lower transfer member interlocked with the lower handle, where the upper handle and the lower handle can be rotated independently to adjust the heights of the respective valve guides.

The height at which the upper transfer member is interlocked with the upper handle can be different from the height at which the lower transfer member is interlocked with the lower handle.

The two pumps can have the same height.

A pump cap can be coupled to the upper portions of the two storage parts, where the pump cap can include pump insertion holes through which the two pumps may be inserted, and the upper handle and the lower handle can be rotatably coupled to the exterior of the pump cap.

The cosmetic container can be configured to prevent of the pumps inserted in the pump insertion holes from rotating.

The cosmetic container can further include a nozzle connected to the two pumps, where the nozzle can include two dispenser holes configured to dispense contents individually from the two storage parts respectively.

A rotation detection means can be provided on a coupling portion between the upper handle and lower handle and the pump cap, where the rotation detection means can allow a detection of the amounts of rotation of the upper handle and lower handle.

The cosmetic container can include a pump module that includes the two pumps, the upper handle, the lower handle, the upper transfer member, and the lower transfer member, where the two storage parts can be coupled to each other and separably coupled with the pump module.

The coupling of the two storage parts can form a circular pump thread, and the pump module can include a storage-part cap that is screw-joined with the pump thread.

An embodiment of the invention described above can provide various advantages, including the following. However, a structure can constitute an embodiment of the invention without necessarily providing all of the advantages below.

An embodiment of the invention can provide a cosmetic container capable of varying the dispensing amount of a content.

Also, an embodiment of the invention can provide a cosmetic container that can adjust the dispensing amounts of two types of contents independently.

Also, an embodiment of the invention can provide a cosmetic container with which the storage part storing a content can be readily replaced.

DETAILED DESCRIPTION OF THE INVENTION

Figure 1:
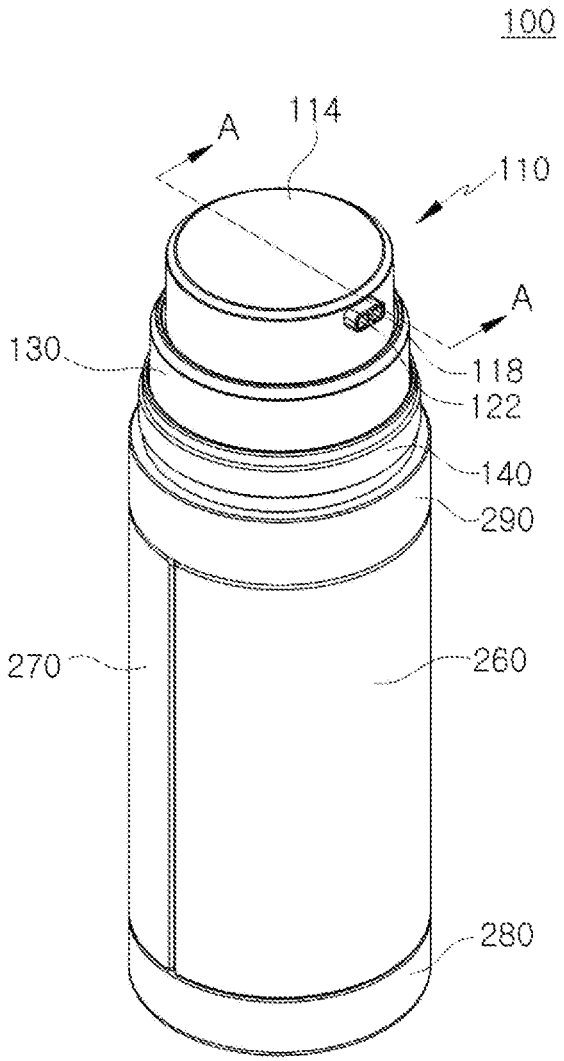
FIG. 1 is a perspective view illustrating a cosmetic container according to a first disclosed embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted, if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., may be used to describe various components, such components must not be limited to the above terms. The above terms are used only to distinguish one component from another.

Certain embodiments of the invention will be described below in more detail with reference to the accompanying drawings. Those components that are the same or are in correspondence are rendered the same reference numeral, and redundant descriptions are omitted.

Figure 2:
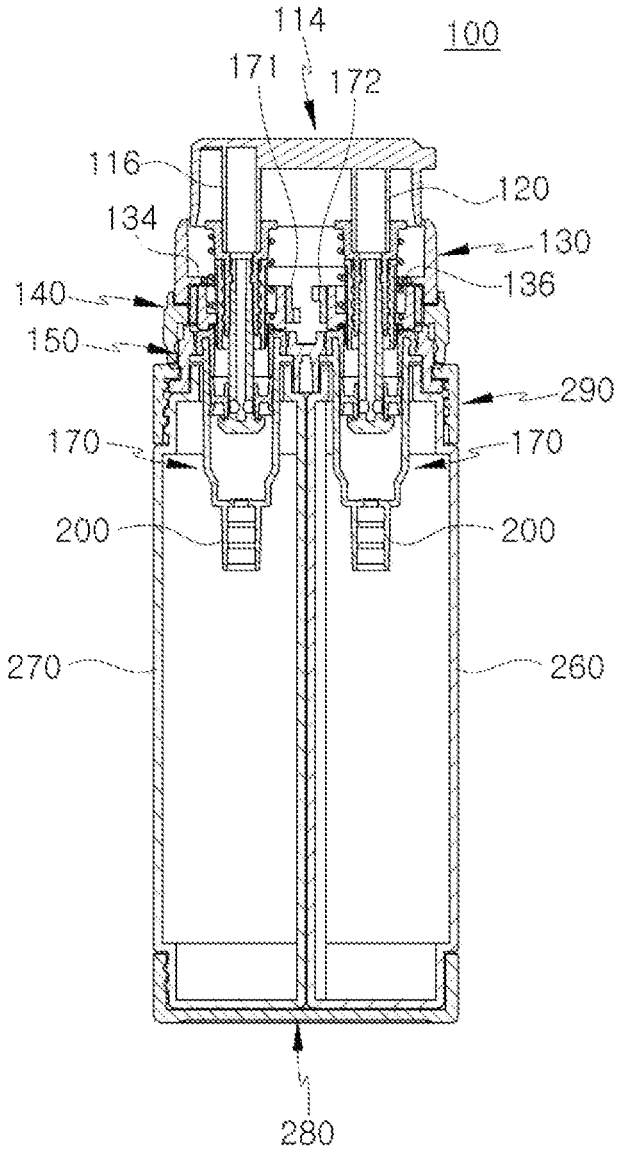
FIG. 2 is a longitudinal cross-sectional view of the cosmetic container across line A-A of FIG. 1.

FIG. 1 is a perspective view illustrating a cosmetic container 100 according to a first disclosed embodiment of the invention, and FIG. 2 is a longitudinal cross-sectional view of the cosmetic container 100 across line A-A of FIG. 1.

Incidentally, FIG. 1 shows an illustration with the over cap 112 (see FIG. 13) removed.

Referring to FIG. 1 and FIG. 2, a cosmetic container 100 based on this embodiment may include a first storage part 260 and a second storage part 270 separated from each other, where each storage part 260, 270 may store a different content. A pump module 110 may be coupled to an upper portion of the storage parts 260, 270 to be capable of dispensing the contents stored in the respective storage parts 260, 270 simultaneously. In this way, a cosmetic container 100 according to this embodiment may be characterized by the ability to dispense two different types of contents.

A cosmetic container 100 based on this embodiment may also be characterized by the ability to adjust the amounts in which the contents stored in the two storage parts 260, 270 are dispensed by the manipulation of the upper handle 130 and lower handle 140. A more detailed description is provided below.

Figure 13:
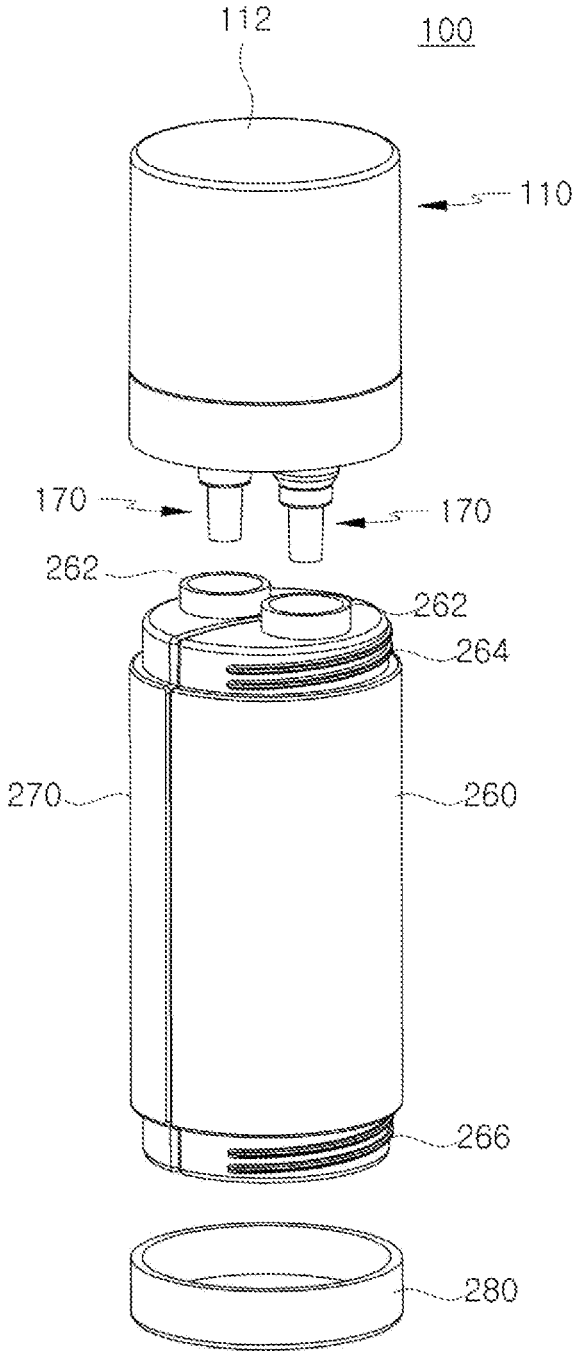
FIG. 13 is a perspective view illustrating the storage parts with the pump module separated.

A cosmetic container 100 based on this embodiment may include a pump module 110, a first storage part 260, a second storage part 270, and a lower cap 280 (see FIG. 13). The pump module 110 may include a nozzle 114, an upper handle 130, a lower handle 140, a pump cap 150, two pumps 170, and a storage-part cap 290.

The nozzle 114 may be coupled to an upper portion of the cosmetic container 100 for pressing by the user and may include an upper surface and a cylindrical form having an open bottom. Within the nozzle 114, there may be provided a first nozzle 116 and a second nozzle 120, which may be hollow and may be formed vertically. The first nozzle 116 and the second nozzle 120 may be coupled and connected respectively to the valve heads 212 of the valves 210 provided in the two pumps 170. A content (not shown) that is raised by the pump 170 may pass through the valve 210 and the first nozzle 116 or second nozzle 120 to be discharged to the outside through a dispenser hole 118, 122 connected with each nozzle.

Figure 3:
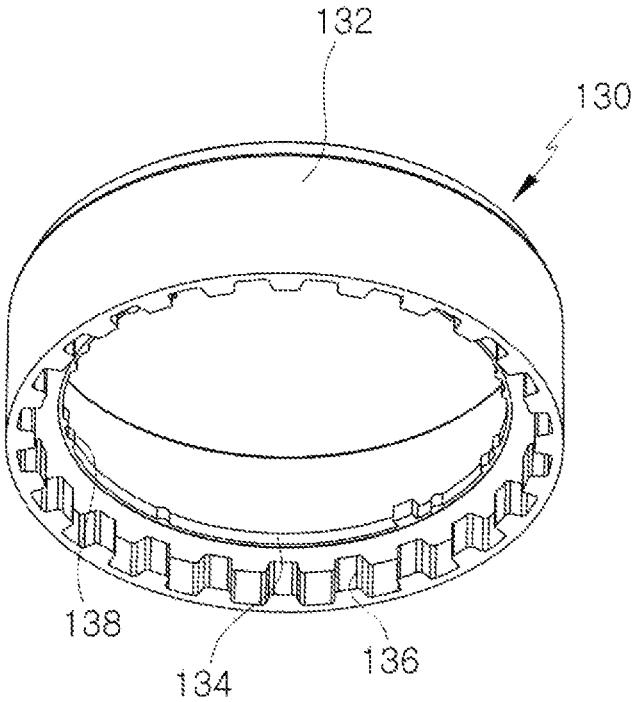
FIG. 3 is a rear perspective view of the upper handle in the cosmetic container illustrated in FIG. 1.

FIG. 3 is a rear perspective view of the upper handle 130 in the cosmetic container 100 illustrated in FIG. 1.

Referring to FIGS. 1 to 3, the upper handle 130 may be positioned below the nozzle 114 and above the lower handle 140 and may be rotated by the user to adjust the one-time dispensing amount of a pump 170 (in FIG. 2, the pump on the right). The upper handle 130 may have the shape of a circular ring having an exterior surface 132 of a certain height and may have an upper ledge 134 and an upper handle gear 136 provided on its inner perimeter.

The upper ledge 134 may protrude inwardly from the inner perimeter of the upper handle 130 and may be formed higher than the upper handle gear 136. The upper ledge 134 may be rotatably inserted into the detent groove 160 formed in the detent protrusion 158 of the pump cap 150 described below, whereby the upper handle 130 may be rotatably coupled to an upper portion of the cosmetic container 100.

On the inner perimeter of the upper ledge 134, rotation detection means 138 shaped as protrusions may be formed in certain intervals. As the rotation detection means 138 pass over protrusions (not shown) formed in the detent groove 160 of the pump cap 150, the user may perceive that the upper handle 130 has been rotated by a certain angle. Such rotation detection means 138 allow the user to readily adjust the one-time dispensing amount of a pump 170.

The upper handle gear 136 may be provided at a lower portion on the inner perimeter of the upper handle 130 and may be interlocked with the spur gear 172 of the transfer member coupled to the right pump 170 in FIG. 2. Thus, a rotation of the upper handle 130 may cause the spur gear 172 and spring washer 180 of the transfer member to rotate, in turn causing the valve guide 230 to rotate along the exterior of the valve 210 and move up or down. The upward and downward movement of the valve guide 230 may adjust the one-time dispensing amount of the pump 170.

Figure 4:
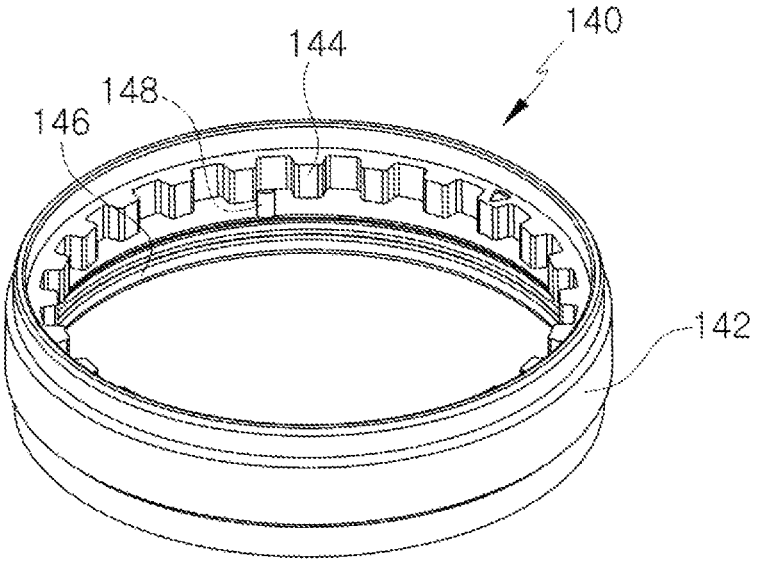
FIG. 4 is a perspective view of the lower handle in the cosmetic container illustrated in FIG. 1.

FIG. 4 is a perspective view of the lower handle 140 in the cosmetic container 100 illustrated in FIG. 1.

Referring to FIG. 1, FIG. 2, and FIG. 4, the lower handle 140 may be positioned below the upper handle 130 and may be rotated by the user to adjust the one-time dispensing amount of a pump 170 (in FIG. 2, the pump on the left). The lower handle 140 may be rotated independently of the upper handle 130. The lower handle 140 may have the shape of a circular ring having an exterior surface 142 of a certain height and may have a lower handle gear 144 and a lower ledge 146 formed on its inner perimeter.

The lower handle gear 144 may be formed at an upper portion on the inner perimeter of the lower handle 140 and may have the lower end of the upper handle 130 positioned on its upper surface. The lower handle gear 144 may be interlocked with the spur gear 171 of the transfer member coupled to the left pump 170 in FIG. 2. Thus, a rotation of the lower handle 140 may cause the spur gear 171 and spring washer 180 of the transfer member to rotate, in turn causing the valve guide 230 to rotate along the exterior of the valve 210 and move up or down. The upward and downward movement of the valve guide 230 may adjust the one-time dispensing amount of the pump 170.

The lower ledge 146 may be formed below the lower handle gear 144 on the inner perimeter of the lower handle 140, where two or more lower ledges 146 may be formed in annular shapes. The lower ledge 146 may be coupled with the rotary protrusion 162 provided on the pump cap 150, whereby the lower handle 140 may be rotatably coupled in relation to the pump cap 150.

Between the lower ledge 146 and the lower handle gear 144, protrusions 148 may be formed in certain intervals, corresponding to rotation detection means. During the rotation of the lower handle 140, the protrusions 148 may pass over a multiple number of rotation detection means 166 provided on the pump cap 150, allowing the user to perceive the rotated amount of the lower handle 140 and readily adjust the one-time dispensing amount of the pump 170.

Figure 5:
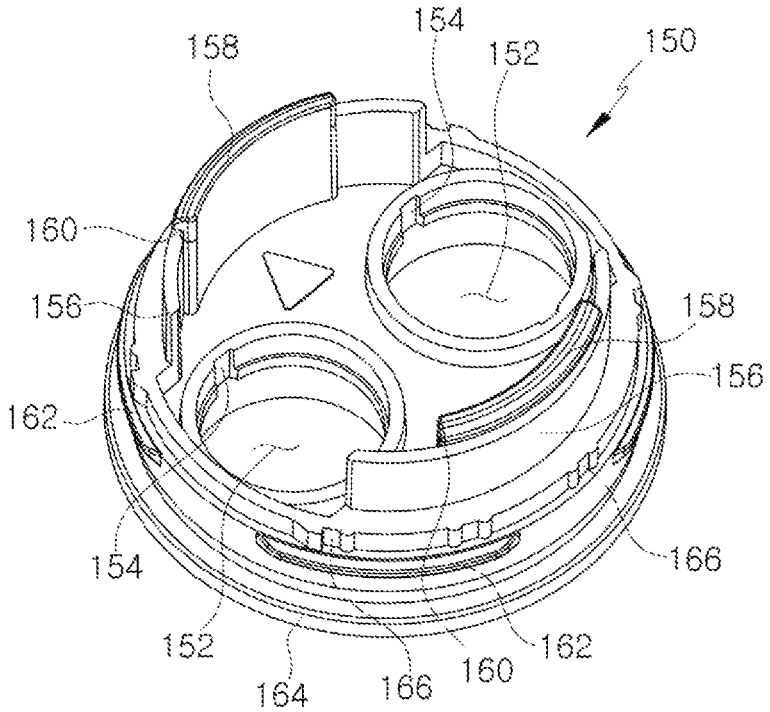
FIG. 5 is a perspective view of the pump cap in the cosmetic container illustrated in FIG. 1.

FIG. 5 is a perspective view of the pump cap 150 in the cosmetic container illustrated in FIG. 1.

Referring to FIG. 2 and FIG. 5, the pump cap 150 may be coupled to the upper portions of the first storage part 260 and second storage part 270 and allow the two pumps 170 to be coupled to their respective storage parts 260, 270. The pump cap 150 may also serve to rotatably support the upper handle 130 and the lower handle 140.

The pump cap 150 may be shaped as a cap having an open bottom and an upper surface, with two pump insertion holes 152 formed in the upper surface through which to insert the pumps 170. In the inner perimeter of a pump insertion hole 152, there may be formed an anti-rotation indentation 154, where a protrusion (not shown) formed in the housing 200 of a pump 170 may be inserted into the anti-rotation indentation 154 to prevent the pump 170 from rotating.

The pump cap 150 may include two upwardly protruding cap exterior surfaces 156. A cap exterior surface 156 may have an arced shape, and at the upper end of the cap exterior surface 156, a detent groove 160 may be formed due to the detent protrusion 158. The upper ledge 134 of the upper handle 130 may be rotatably coupled to the detent groove 160.

The rotation detection means 166 may be formed on the outer perimeter of the pump cap 150, and as the protrusions 148 provided on the lower handle 140 pass over the rotation detection means 166, the user can recognize the rotated amount of the lower handle 140.

On the outer perimeter of the pump cap 150, a multiple number of rotary protrusions 162 may be formed in certain intervals. The rotary protrusions 162 may be rotatably inserted into the lower ledges 146 of the lower handle 140.

At the lower end on the outer perimeter of the pump cap 150, a flange 164 may be formed protruding outward. An upper portion of the storage-part cap 290 may be inserted into the groove (no numeral assigned) formed between the flange 164 and the rotary protrusions 162, whereby the storage-part cap 290 and the pump cap 150 may be rotatably coupled to each other.

While the cosmetic container 100 according to this embodiment is illustrated as having two pumps 170, a cosmetic container according to another embodiment of the invention can include just one pump 170, in which case the pump cap can also include one pump insertion hole 152.

The storage-part cap 290 may be coupled to a lower portion of the pump cap 150. The storage-part cap 290, which may be positioned at the lowermost portion of the pump module 110, may have the pump cap 150 inserted onto its top and may have its bottom open. A thread (no numeral assigned) may be formed in the inner perimeter of the storage-part cap 290, where the thread may be screw-joined with the pump threads 264 formed on the outer perimeters of the upper portions of the first storage part 260 and second storage part 270. As the storage-part cap 290 is thus screw-joined to two storage parts 260, 270, the pump module 110 can be coupled to or separated from the two storage parts 260, 270, and the storage parts 260, 270 can be replaced with new parts.

As the storage-part cap 290 is rotatable with respect to the pump cap 150, it is possible to screw-join the pump module 110 onto the upper portions of the two storage parts 260, 270.

Figure 6:
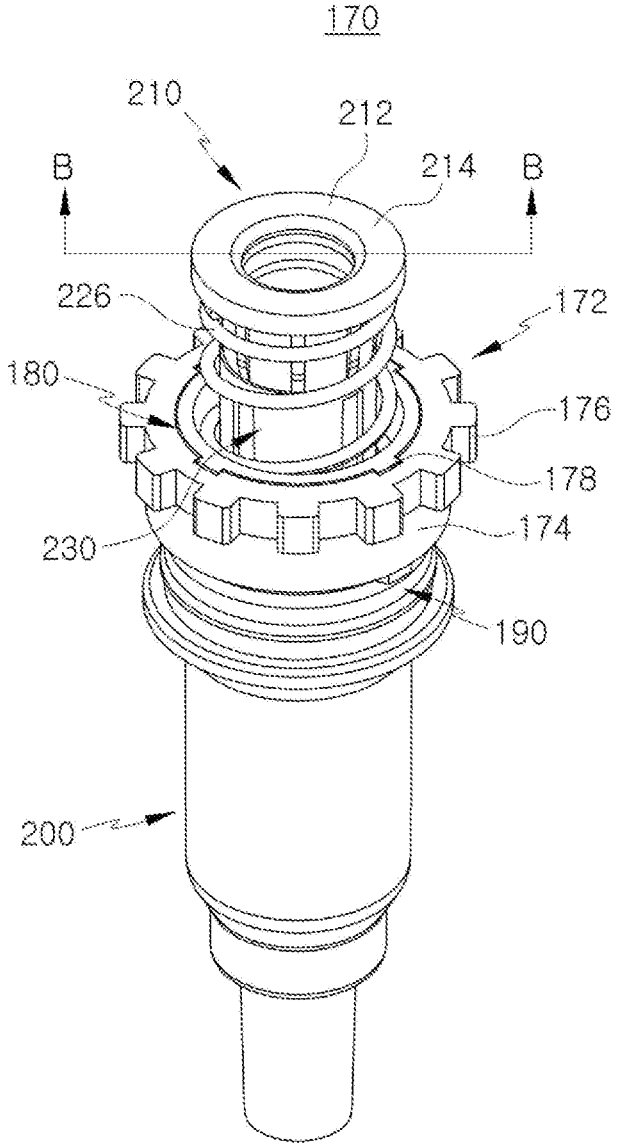
FIG. 6 is a perspective view of a pump in the cosmetic container illustrated in FIG. 1.
Figure 7:
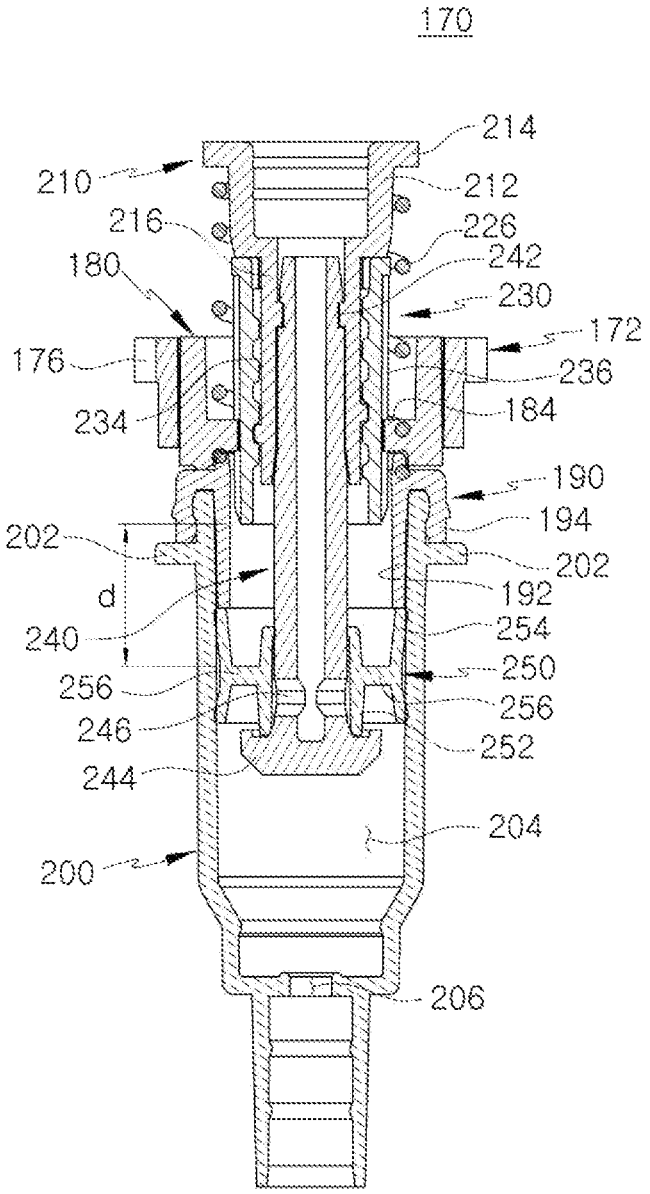
FIG. 7 is a central longitudinal cross-sectional view of the pump across line B-B of FIG. 6.

FIG. 6 is a perspective view of a pump 170 in the cosmetic container 100 illustrated in FIG. 1, and FIG. 7 is a central longitudinal cross-sectional view of the pump 170 across line B-B of FIG. 6.

Incidentally, FIG. 6 and FIG. 7 illustrate the pump 170 positioned on the right from between the two pumps illustrated in FIG. 2. The two pumps 170 in FIG. 2 may have substantially the same composition with the exception that the heights of the gear indentations 178 in the coupled spur gears 172 are different.

Referring to FIG. 6 and FIG. 7, the pump 170 may form a part of the pump module 110 and may be operated by the downward movement of the nozzle 114 to dispense a content from the first storage part 260 or second storage part 270. On the exterior of the pump 170, there may be provided a transfer member, which may include a spur gear 172 and a spring washer 180, to allow an adjustment of the one-time dispensing amount of the pump 170 by a rotation of the upper handle 130.

Figure 8:
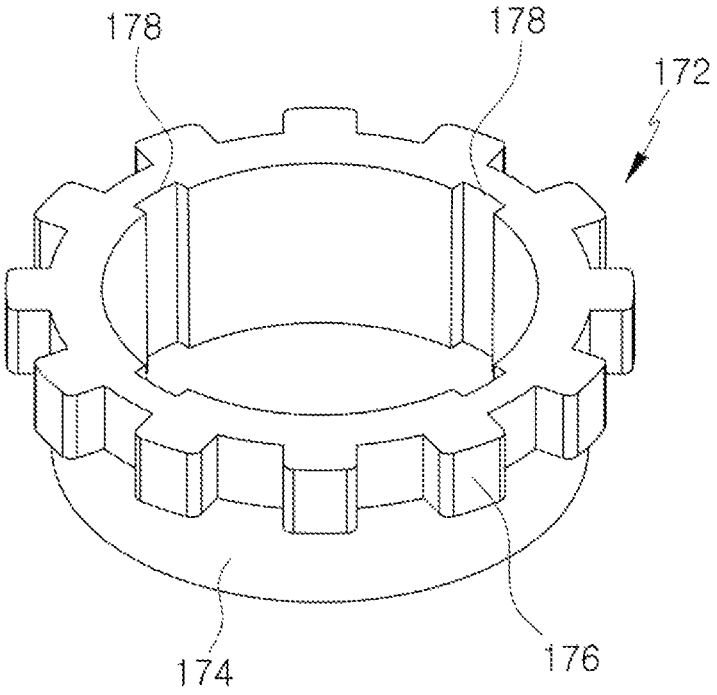
FIG. 8 is a perspective view of the spur gear in the pump illustrated in FIG. 6.
Figure 9:
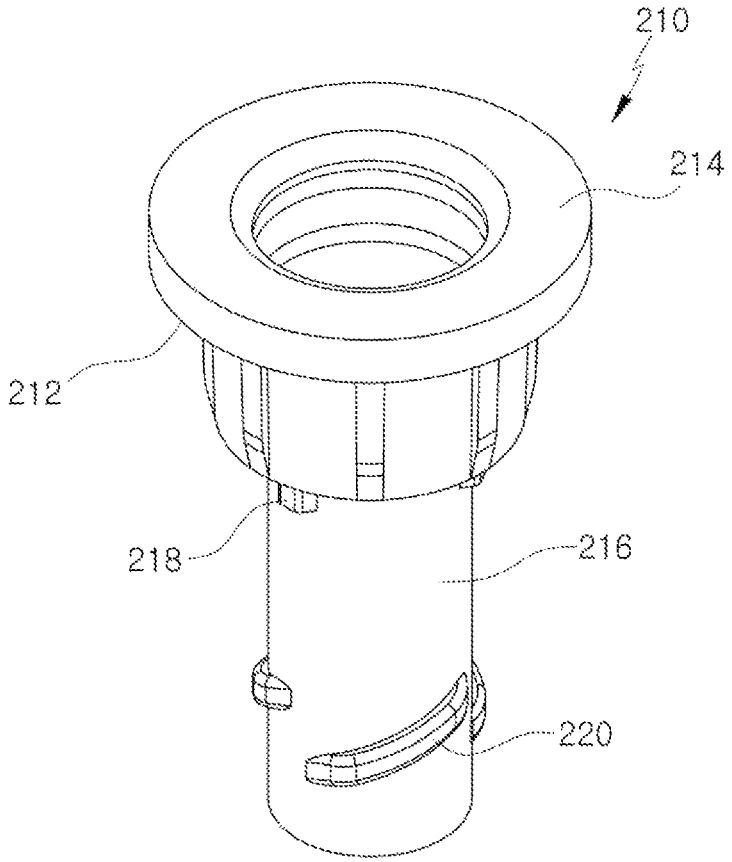
FIG. 9 is a perspective view of the valve in the pump illustrated in FIG. 6.
Figure 10:
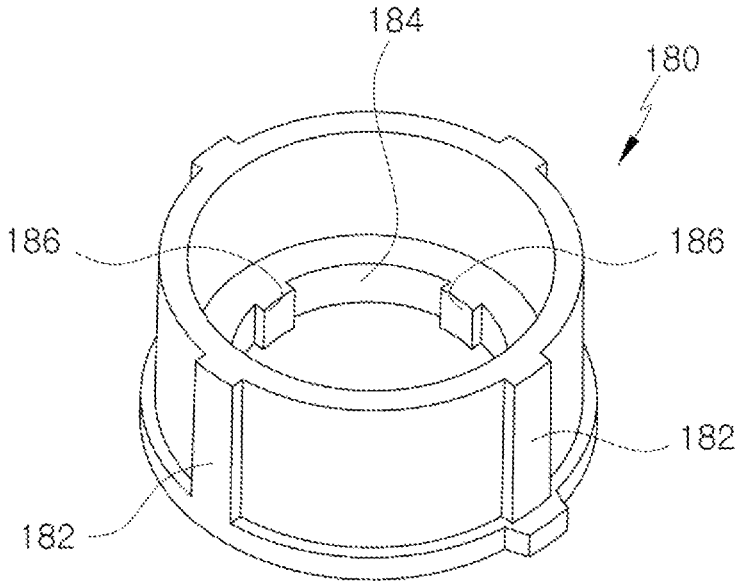
FIG. 10 is a perspective view of the spring washer in the pump illustrated in FIG. 6.
Figure 11:
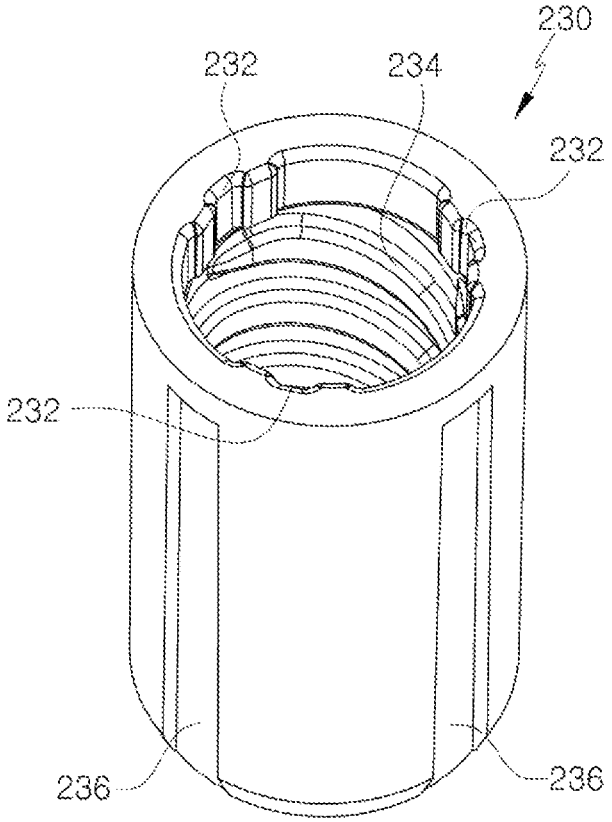
FIG. 11 is a perspective view of the valve guide in the pump illustrated in FIG. 6.

FIG. 8 is a perspective view of the spur gear 172 in the pump 170 illustrated in FIG. 6, and FIG. 9 is a perspective view of the valve 210. FIG. 10 is a perspective view of the spring washer 180 in the pump 170 illustrated in FIG. 6, and FIG. 11 is a perspective view of the valve guide 230.

Referring to FIGS. 6 to 11, on the exterior of the pump 170, there may be provided a spur gear 172, which corresponds to the transfer member. A gear 176 may be formed on the upper portion of the outer perimeter of the spur gear 172, being interlocked with the upper handle gear 136 of the upper handle 130. Thus, rotating the upper handle 130 may cause the spur gear 172 to rotate in the same direction and thus also rotate the spring washer 180 and the valve guide 230.

The spur gear 172 may include a body 172 that is shaped as a hollow cylinder with both ends open. The spring washer 180 may be inserted within the body 172. The gear indentations 178 may be formed in the inner perimeter of the body 172, where outer protrusions 182 formed on the outer perimeter of the spring washer 180 may be inserted in the gear indentations 178. The gear indentations 178 and outer protrusions 182 allow the spur gear 172 and spring washer 180, which correspond to the transfer member, to rotate together as an integrated body.

The spring washer 180 may be shaped as a hollow cylinder with both the top and bottom open and may be positioned between the spur gear 172 and the valve guide 230. On the outer perimeter of the spring washer 180, there may be formed outer protrusions 182, which have already been described above and will not be described here in further detail.

A washer ledge 184 may be formed at the lower end on the inner perimeter of the spring washer 180. The washer ledge 184 may be formed protruding inward, and a multiple number of washer protrusions 186 may be formed in certain intervals on the inner perimeter of the washer ledge 184. A lower end of a spring 226 may be positioned on the washer ledge 184. The washer protrusions 186 may be inserted into rotary grooves 236 formed in the outer perimeter of the valve guide 230, whereby the spring washer 180 and the valve guide 230 may rotate together as an integrated body.

The housing cover 190 may be positioned below the spring washer 180. The housing cover 190 may be inserted into the open top of the housing 200 and may include a body 192 having a cylindrical shape and a flange 194 formed protruding from the outer perimeter of the body 192.

The body 192 of the housing cover 190 may be inserted through the open top of the housing 200 and may have the shape of a hollow cylinder with both the upper end and lower end open. The upper end of the body 192 can be in contact with a lower surface of the washer ledge 184 of the spring washer 180. The lower end of the body 192 can be in contact with the upper end of the piston 250, to thereby limit the upward movement of the piston 250.

The flange 194 may be formed protruding outwardly from the outer perimeter of the body 192 and may have a cross section shaped as an inverted "L". The flange 194 may be in tight contact with the outer perimeter at the upper end of the housing 200, whereby the housing cover 190 can be firmly secured to the housing 200.

The housing 200 may correspond to the body of the pump 170 and may have an interior space 204 into which a content may be drawn from a storage part 260, 270 by a pumping action. An inlet hole 206 may be provided in the housing 200 for the drawing in of the content, and at the inlet hole 206, there may be provided a valve (not shown) that is opened or closed according to the pressure difference between the interior space 204 and the storage part 260, 270. As the valve corresponds to known technology, disclosed for example in Korean Registered Patent No. 1951627, the valve will not be described here in further detail.

The piston 250 may be movably positioned in the interior space 204, and a piston guide 240 may be inserted onto the piston 250. The process by which a content is drawn into and discharged from the inside of the interior space 204 is described in detail in documents such as Korean Registered Patent No. 1951627, and as the pumps of the cosmetic container 100 according to this embodiment may employ the same discharging operation, the discharging process will not be described here in further detail.

On the outer perimeter of the housing 200, there may be provided a flange 202. The flange 202 may contact an upper end of a coupler head 262, which may correspond to an entrance of the first storage part 260 or second storage part 270, whereby the housing 200 may be placed above the coupler head 262 of the storage part 260, 270.

The valve 210, which may move downward or upward together with the downwardly pressed nozzle 114 to perform a dispensing action, may include a valve head 212 and a valve body 216.

The valve head 212 may have the shape of a hollow cylinder with an open top, where the first nozzle 116 or second nozzle 120 of the nozzle 114 may be inserted to and be connected with the inside of the valve head 212. The valve head 212 may also connect with the valve body 216. Also, a head flange 214 may be provided at the upper end on the outer perimeter of the valve head 212. The lower surface of the head flange 214 may contact the upper end of the spring 226. Thus, when the external force is removed, the valve 210 and valve guide 230 and the piston 250 may be moved upward by the elastic restoring force of the spring 226.

The valve body 216 may have the shape of a hollow cylinder with both the upper end and lower end open and may connect with the valve head 212 and the piston guide 240. Guide protrusions 220 may be formed on the outer perimeter of the valve body 216, where the guide protrusions 220 may be screw-joined to the guide thread 234 formed in the inner perimeter of the valve guide 230. As the guide protrusion 220 and the guide thread 234 are screw-joined together, the valve guide 230 may move upward or downward while rotating around the exterior of the valve 210. Here, the valve 210 may not be rotated.

At an upper end of the valve body 216, there may be valve protrusions 218 formed. The valve protrusions 218 can be inserted into the guide indentations 232 formed in the upper end of the valve guide 230, whereby the valve guide 230 can be prevented from rotating and stopped from moving upward.

The valve guide 230 may be rotatably coupled to the exterior of the valve body 216 and may be rotated in linkage with the rotation of the upper handle 130 or lower handle 140 to be moved upward or downward. A greater distance (d in FIG. 7) between the valve guide 230 and the piston 250 may result in the inlet holes 246 formed in the piston guide 240 remaining open for a longer duration and hence an increased amount of the content being drawn.

The valve guide 230 may be shaped as a hollow cylinder with both the upper end and lower end open, and guide threads 234 may be formed within. The guide threads 234 may be screw-joined with the guide protrusions 220 formed on the outer perimeter of the valve body 216, whereby the valve guide 230 may be rotated along the outer perimeter of the valve 210 to be moved upward or downward.

The rotary grooves 236 may be formed in the outer perimeter of the valve guide 230 along the longitudinal direction. The washer protrusions 186 of the spring washer 180 may be inserted in the rotary grooves 236, whereby the spring washer 180 and the valve guide 230 may rotate together as an integrated body.

At the upper end in the inner perimeter of the valve guide 230, there may be formed guide indentations 232, which have already been described above and will not be described here in further detail.

The piston guide 240 may have a portion thereof inserted within the valve 210 and may move up and down together with the valve 210, while the piston 250 may be positioned in a movable manner around the exterior of the lower portion of the piston guide 240. The piston guide 240 may have the shape of a hollow cylinder and may be provided with a guide head 244, which may have a larger diameter, at its lower end. A coupler indentation 242 may be formed in the outer perimeter of the piston guide 240, where a protrusion (no numeral assigned) formed on the inner perimeter of the valve 210 may be inserted in the coupler indentation so as to enable the valve 210 and the piston guide 240 to move up and down as an integrated body.

The inlet holes 246 may be formed in a lower portion of the piston guide 240. When the piston 250 is positioned around the inlet holes 246 (as illustrated in FIG. 7), the inlet holes 246 may be closed, and the content drawn into the interior space 204 may not enter the inside of the piston guide 240. When the piston 250 is not positioned around the inlet holes 246, the inlet holes 246 may be opened, and the content that was drawn into the interior space 204 may enter the inside of the piston guide 240, pass through the valve 210 and nozzle 114, and be discharged to the outside. The longer the duration of the inlet holes 246 remaining open (i.e., the slower the downward movement of the piston 250 compared to the downward movement of the piston guide 240), the greater would be the amount of content discharged by a one-time operation of the pump 170.

At the lower end of the piston guide 240, there may be provided a guide head 244, which may have a larger diameter compared to other portions. The diameter of the guide head 244 may be formed larger than that of the guide contact part 252 of the piston 250. Therefore, after the piston guide 240 and the piston 250 have been moved downward together and while the piston guide 240 and the piston 250 are being moved back up by the elastic restoring force of the spring 226, the piston 250 may be caught on the guide head 244 and may move upward concurrently with the piston guide 240.

The piston 250 may include a guide contact part 252, which may be placed in tight contact with the exterior of the piston guide 240, a housing contact part 254, which may be placed in tight contact with the inner perimeter of the housing 200, and a connection part 256, which may connect these parts to each other.

The guide contact part 252 can maintain tight contact with the outer perimeter of the piston guide 240 to close the inlet holes 246. When the valve 210 and the valve guide 230 are moved downward, the piston 250 may be moved relatively slowly due to the friction with the housing contact part 254, whereby the inlet holes 246 may be opened, and the content that was drawn into the interior space 204 may enter the inside of the piston guide 240.

If the valve guide 230 is moved further down compared to the state shown in FIG. 7 due to the operation of the upper handle 130 or lower handle 140, the valve guide 230 can more quickly press down on the connection part 256 when the valve guide 230 is moved down together with the valve 210. As a result, the downward movement of the piston 250 may be achieved sooner, and duration of the inlet holes 246 remaining open may be decreased. A decrease in the duration of the inlet holes 246 remaining open would mean that the amount of content discharged by a one-time operation of the pump 170 would be reduced.

The housing contact part 254 may maintain tight contact with the inner perimeter of the housing 200 to delay the downward movement of the piston 250 in spite of the downward movement of the valve 210 and valve guide 230.

While the cosmetic container 100 according to this embodiment is illustrated as having two pumps 170, another embodiment of the invention can include just one pump 170. A cosmetic container having just one pump can include one handle.

In a cosmetic container according to another embodiment of the invention, the valve 210 and the valve guide 230 can be formed as an integrated body. Also, in a cosmetic container according to another embodiment of the invention, the spur gear 172 and spring washer 180 corresponding to a transfer member can be formed as an integrated body.

In the foregoing, the pump 170 and the spur gear 172 are described for the pump 170 positioned on the right, from between the two pumps 170 illustrated in FIG. 2. The pump 170 positioned on the left can have the same composition as the pump 170 positioned on the right and thus will not be described here in further detail. It should be noted, however, that the spur gear 171 coupled to the left pump 170 may be formed with the gears 176 positioned lower compared to the spur gear 172 of the pump located on the right. The spur gear 171 may be interlocked with the lower handle 140.

The structure and operation of the pumps 170 may be identical or similar to those of the pump disclosed in Korean Registered Patent No. 1951627 and thus will not be described here in further detail.

Figure 12:
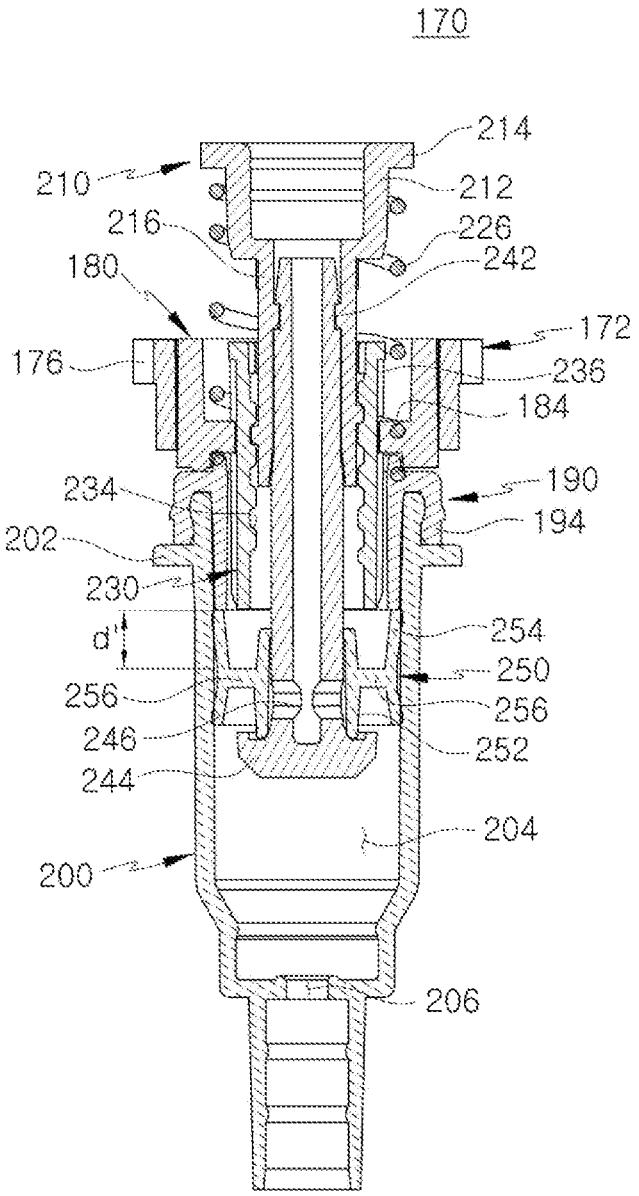
FIG. 12 is a cross-sectional view illustrating the pump of FIG. 7 with the valve guide moved down.

FIG. 12 is a cross-sectional view illustrating the valve guide 230 after it is moved down from the state illustrated in FIG. 7.

Referring to FIG. 7 and FIG. 12, when the valve guide 230 is moved downward by the rotation of the upper handle 130 or lower handle 140, the distance (d) between the lower end of the valve guide 230 and the connection part 256 of the piston 250 may be decreased (d'<d). When the distance (d) is decreased, the valve guide 230 may contact the connection part 256 earlier when moved downward, whereby the piston 250 may also be moved down earlier, and the inlet holes 246 may be closed sooner.

The state shown in FIG. 7 corresponds to the case in which the valve guide 230 is at its highest possible position such that the distance (d) is at a maximum value. In this case, the downward movement of the piston 250 can be achieved not by the valve guide 230 but by the downward force of the piston guide 240 only. With the state shown in FIG. 7, the amount of content discharged by a one-time operation of the pump 170 is at a maximum.

The state shown in FIG. 12 corresponds to a case in which the valve guide 230 has been lowered compared to the state shown in FIG. 7 such that the distance (d') has been decreased compared to the distance (d) in FIG. 7. In this case, as the valve guide 230 is moved down, the valve guide 230 can press down on the connection part 256 of the piston 250 earlier compared to the state shown in FIG. 7, and as a result, the piston 250 can be moved down sooner, and the point at which the inlet holes 246 are closed can be made earlier. In this way, decreasing the distance between the valve guide 230 and the connection part 256 may allow the inlet holes 246 to be closed earlier, so that the amount of content discharged by a one-time dispensing of the pump 170 may be decreased.

Thus, with a cosmetic container 100 according to this embodiment, a user can readily adjust the amount of content dispensed by the operation of a pump 170 by manipulating at least one of the upper handle 130 and the lower handle 140. Also, the cosmetic container 100 according to this embodiment may have two storage parts 260, 270 and thus may be capable of simultaneously discharging two different types of contents, allowing the user to readily control the mixture ratio of the contents by controlling the one-time discharging amount of the pump 170 connected to each of the storage parts 260, 270.

FIG. 13 is a perspective view illustrating the storage parts 260, 270 with the pump module 110 separated.

Referring to FIG. 13, the pump module 110 can be separated from the two storage parts 260, 270. The storage parts 260, 270 can be replaced as necessary, after which the semicircularly shaped storage parts 260, 270 can be attached to each other to form a cylindrical shape, and the pump module 110 can be coupled thereto. A lower cap 280 can be coupled also to the lower portions of the two storage parts 260, 270 forming a cylindrical shape, so as to prevent the storage parts 260, 270 from being separated.

The two storage parts 260, 270 can have semicircular shapes and substantially the same composition and can be formed symmetrically to each other. On the upper portions of the storage parts 260, 270, there may be formed coupler heads 262, which may be inserted into the lower portion of the pump cap 150. The coupler heads 262 may correspond to passageways through which the contents stored in the storage parts 260, 270 are discharged to the outside and may receive the pumps 170 inserted therein.

The pump threads 264 may be formed on the outer perimeter at the upper portions of the storage parts 260, 270, and the thread (no numeral assigned) formed in the inner perimeter of the storage-part cap 290 may be screw-joined to the pump threads 264. As a result, the pump module 110 may be separably coupled to the upper portions of the two storage parts 260, 270 adjoining each other.

Cap threads 266 may be formed on the outer perimeter at the lower portions of the storage parts 260, 270, and the thread formed in the inner perimeter of the lower cap 280 may be screw-joined to the cap threads 266. As a result, the two storage parts 260, 270 can be coupled more securely.

Thus, the cosmetic container 100 according to this embodiment provides the advantage that the storage parts 260, 270 can be readily replaced, since the pump module 110 coupled to the upper portions of the storage parts 260, 270 can be easily separated from the storage parts 260, 270. Such structure that allows refills can be even more useful in the context of a variable dispensing structure, as is the case with a cosmetic container 100 according to this embodiment. That is, as the contents stored in the storage parts 260, 270 can be dispensed in variable amounts, the rates of consumption of the contents can differ. However, when a content stored in one storage part 260, 270 is depleted, the user may simply replace the storage part 260, 270 with a new one storing the depleted content and continue to use the cosmetic container 100.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A cosmetic container comprising:

a storage part configured to store a content;

a pump coupled to the storage part and configured to dispense the content, the pump comprising a valve configured to move downward by a pressing;

a handle rotatably coupled to an upper portion of the storage part;

a transfer member interlocked with the handle and configured to transfer a rotation of the handle to a valve guide; and the valve guide configured to move upward or downward along an exterior of the valve when rotated by the transfer member, wherein rotating the handle adjusts a relative position of the valve guide with respect to the valve to allow a varying of a dispensing amount of the content, wherein a guide protrusion shaped as a thread is formed on an outer perimeter of the valve, and a guide thread is formed in an inner perimeter of the valve guide, the guide protrusion being rotatably inserted in the guide thread.

2. The cosmetic container of claim 1, wherein the transfer member is provided at an inner side of the handle.

3. The cosmetic container of claim 2, wherein the handle has a handle gear formed on an inner perimeter thereof, the transfer member comprises a spur gear and a spring washer, the spur gear interlocked with the handle gear, the spring washer configured to rotate together with the spur gear as an integrated body at an inner side of the spur gear, and the spring washer is configured to guide an upward and downward movement of the valve guide while rotating together with the valve guide as an integrated body.

4. The cosmetic container of claim 1, wherein the pump comprises a piston guide and a piston, the piston guide coupled to the valve and comprising an inlet hole, the piston coupled to an exterior of the piston guide and capable of closing the inlet hole, and a one-time dispensing amount of the pump is adjusted in proportion to a distance between the valve guide and the piston.

5. The cosmetic container of claim 1, having two storage parts and two pumps, wherein the handle comprises an upper handle and a lower handle having different heights, the transfer member comprises an upper transfer member and a lower transfer member, the upper transfer member interlocked with the upper handle, the lower transfer member interlocked with the lower handle, and the upper handle and the lower handle are configured to be rotated independently to adjust heights of the respective valve guides.

6. The cosmetic container of claim 5, wherein a height at which the upper transfer member is interlocked with the upper handle is different from a height at which the lower transfer member is interlocked with the lower handle.

7. The cosmetic container of claim 5, wherein the two pumps have a same height.

8. The cosmetic container of claim 5, wherein a pump cap is coupled to upper portions of the two storage parts, the pump cap comprises pump insertion holes configured to receive the two pumps inserted therein, and the upper handle and the lower handle are rotatably coupled to an exterior of the pump cap.

9. The cosmetic container of claim 8, wherein an anti-rotation indentation is formed in an inner perimeter of each pump insertion hole to prevent rotation of the pumps inserted in the pump insertion holes.

10. The cosmetic container of claim 5, further comprising:

a nozzle connected to the two pumps, the nozzle comprising two dispenser holes, the two dispenser holes configured to dispense contents individually from the two storage parts respectively.

11. The cosmetic container of claim 5, wherein a rotation detection means is provided on a coupling portion between the upper handle and lower handle and the pump cap, the rotation detection means configured to allow a detection of amounts of rotation of the upper handle and lower handle.

12. The cosmetic container of claim 5, comprising a pump module, the pump module comprising the two pumps, the upper handle, the lower handle, the upper transfer member, and the lower transfer member, wherein the two storage parts are coupled to each other and separably coupled with the pump module.

13. The cosmetic container of claim 12, wherein the coupling of the two storage parts forms a circular pump thread, and the pump module comprises a storage-part cap screw-joined with the pump thread.

14. A cosmetic container comprising:

a first storage part configured to store a first content;

a second storage part configured to store a second content;

a first pump coupled to the first storage part and configured to dispense the first content, the first pump comprising a first valve configured to move downward by a pressing;

a second pump coupled to the second storage part and configured to dispense the second content, the second pump comprising a second value configured to move downward by a pressing;

an upper handle rotatably coupled to an upper portion of the first storage part;

a lower handle rotatably coupled to an upper portion of the second storage part, the upper and lower handles having different heights;

a first valve guide configured to move upward and downward along an exterior of the first valve;

a second valve guide configured to move upward and downward along an exterior of the second valve;

an upper transfer member interlocked with the upper handle and configured to transfer a rotation of the upper handle to the first valve guide; and a lower transfer member interlocked with the lower handle and configured to transfer a rotation of the lower handle to the second valve guide, wherein a rotation of the upper handle adjusts a relative position of the first valve guide with respect to the first valve to change a dispensing amount of the first content, and a rotation of the lower handle adjusts a relative position of the second valve guide with respect to the second valve to change a dispensing amount of the second content, wherein the upper and lower handles are configured to be rotated independently to adjust heights of the first and second valve guides, respectively.

* * * * *